US007703156B2

(12) United States Patent
Lee

(10) Patent No.: US 7,703,156 B2
(45) Date of Patent: Apr. 27, 2010

(54) SIDE COVER APPARATUS FOR ELECTRIC MAT

(76) Inventor: Myoung Jun Lee, 261 W. Rivera Ct., La Habra, CA (US) 90631

( * ) Notice: Subject to any disclaimer, the term of this patent is extended or adjusted under 35 U.S.C. 154(b) by 0 days.

(21) Appl. No.: 12/062,216

(22) Filed: Apr. 3, 2008

(65) Prior Publication Data

US 2009/0126109 A1 May 21, 2009

(30) Foreign Application Priority Data

Nov. 16, 2007 (KR) ..... 20-2007-0018496 U

(51) Int. Cl.
*A47G 9/04* (2006.01)
*H05B 1/00* (2006.01)

(52) U.S. Cl. ..... 5/500; 5/497; 5/421; 219/212

(58) Field of Classification Search ..... 5/421, 5/500, 502, 497, 496, 498, 482; 219/212, 219/529

See application file for complete search history.

(56) References Cited

U.S. PATENT DOCUMENTS

| | | | | | |
|---|---|---|---|---|---|
| 2,856,615 | A | * | 10/1958 | Cirocco | 5/500 |
| 4,074,107 | A | * | 2/1978 | Moss | 219/212 |
| 4,970,744 | A | * | 11/1990 | Davis | 5/496 |
| 5,046,207 | A | * | 9/1991 | Chamberlain | 5/496 |
| 5,285,542 | A | * | 2/1994 | West et al. | 5/500 |
| 5,628,077 | A | * | 5/1997 | Briganti | 5/496 |
| 6,088,858 | A | * | 7/2000 | Juster et al. | 5/737 |

* cited by examiner

*Primary Examiner*—Alexander Grosz
(74) *Attorney, Agent, or Firm*—Lee, Hong, Degerman, Kang & Waimey

(57) ABSTRACT

A side cover apparatus includes an electric mat, a curtain-type side cover attached to an outer periphery of the electric mat, and a contracting portion disposed on an inner periphery of the side cover. The side cover conceals side surfaces of the electric mat and a bed mattress such that the combination of the electric mat and the bed mattress appears as if the combination is a single bed mattress.

7 Claims, 6 Drawing Sheets

SIDE COVER APPARATUS FOR ELECTRIC MAT

CROSS-REFERENCE TO RELATED APPLICATION

Pursuant to 35 U.S.C. §119(a), this application claims the benefit of earlier filing date and right of priority to Korean Application No. 20-2007-0018496, filed on Nov. 16, 2007, the contents of which are hereby incorporated by reference herein in their entirety.

FIELD OF THE INVENTION

The present invention relates to a side cover apparatus for an electric mat. More particularly, the present invention relates to a side cover apparatus for an electric mat, in which a curtain-type side cover is attached to an outer periphery of the electric mat and a contracting portion is formed on an inner periphery of the side cover such that when the electric mat is assembled to a bed mattress, the electric mat appears as if it is a part of the bed mattress.

DESCRIPTION OF THE RELATED ART

An electric mat is often placed on top of a bed mattress for use thereon. This is particularly true in Korea where an increasing number of Koreans adopt the usage of western-style beds but desire to maintain some form of traditional Korean underfloor heating system. A bed mattress provides thick cushioning while an electric mat provides warmth. By combining the bed mattress and the electric mat, users may realize comfortable relaxation and sleep.

However, placing the electric mat on the bed mattress results in various problems. First, even if the electric mat is initially placed on the bed mattress in a manner aligned with the same, the electric mat, which has a relatively small thickness, tends to be displaced horizontally such that the bed no longer has a neat outer appearance. In an attempt to remedy this problem, a securing string is attached to the electric mat and the electric mat is tied to the bed mattress using the securing string. However, a favorable integral combination of the bed mattress and electric mat is still not achieved through such a configuration because the configuration still fails to hold the electric mat on the bed mattress securely and neatly. Second, since the placement of the electric mat on the bed mattress is visible, the overall appearance of the bedroom becomes untidy. Thus, it is evident that the development of the electric mat has been insufficient, particularly in view of the fact that the electric mat is used in the bedroom environment where tidiness is desirable.

SUMMARY OF THE INVENTION

Aspects of the present invention provide a side cover apparatus for an electric mat of which, when the electric mat of the present invention is placed on a bed mattress, the electric mat does not move horizontally on the bed mattress.

Aspects of the present invention also provide a side cover apparatus for an electric mat of which, when the electric mat is placed on a bed mattress, the outer appearance is as if these two elements are a single bed mattress.

Aspects of the present invention also provide a side cover apparatus for an electric mat of which a curtain-type side cover is connected to an outer periphery of the electric mat.

Aspects of the present invention also provide a side cover apparatus for an electric mat of which a contracting portion is provided on an inner periphery of the curtain-type side cover.

Aspects of the present invention also provide a side cover apparatus for an electric mat of which a curtain-type side cover conceals a side surface of the bed mattress.

Aspects of the present invention also provide a side cover apparatus for an electric mat of which the electric mat may be used in place of a bed sheet when placed on a bed mattress.

Aspects of the present invention also provide a side cover apparatus for an electric mat of which the electric mat is easily assembled to a bed mattress.

Aspects of the present invention also provide a side cover apparatus for an electric mat of which a side cover protects an upper surface of the electric mat during transport.

Aspects of the present invention also provide a side cover apparatus for an electric mat of which, after the electric mat is laid out on a bed mattress and a contracting portion of a side cover is manipulated in order to be placed under the bed mattress, the side cover surrounds and closely contacts a side surface of the bed mattress.

However, the aspects of the present invention are not restricted to the one set forth herein. The above and other aspects of the present invention will become more apparent to one of daily skill in the art to which the present invention pertains by referencing a detailed description of the preferred embodiments of the present invention given below.

According to an aspect of the present invention, there is provided a side cover apparatus including an electric mat, a curtain-type side cover attached to an outer periphery of the electric mat, and a contracting portion disposed on an inner periphery of the side cover. A length of the side cover conceals a side surface of the bed mattress and closely contacts a bottom surface of the bed mattress.

The side cover is inserted under a bias of the electric mat at an upper surface of the electric mat and attached to the bias through a stitched seam such that the side cover simultaneously conceals the bias of the electric mat and the side surface of the bed mattress.

The contracting portion on the inner periphery of the side cover includes a contracting tube formed by stitching the inner periphery of the side cover, and one of an elastic band and a tightening band inserted into the contracting tube.

BRIEF DESCRIPTION OF THE DRAWINGS

The above and other features and advantages of the present invention will become more apparent by describing in detail exemplary embodiments thereof with reference to the attached drawings.

DETAILED DESCRIPTION OF THE PREFERRED EMBODIMENTS

The present invention will now be described more fully with reference to the accompanying drawings, in which exemplary embodiments of the invention are shown. The invention may, however, be embodied in many different forms and should not be construed as being limited to the embodiments set forth herein. Rather, these embodiments are provided so that this disclosure will be thorough and complete, and will fully convey the concept of the invention to those skilled in the art.

Figure 1:
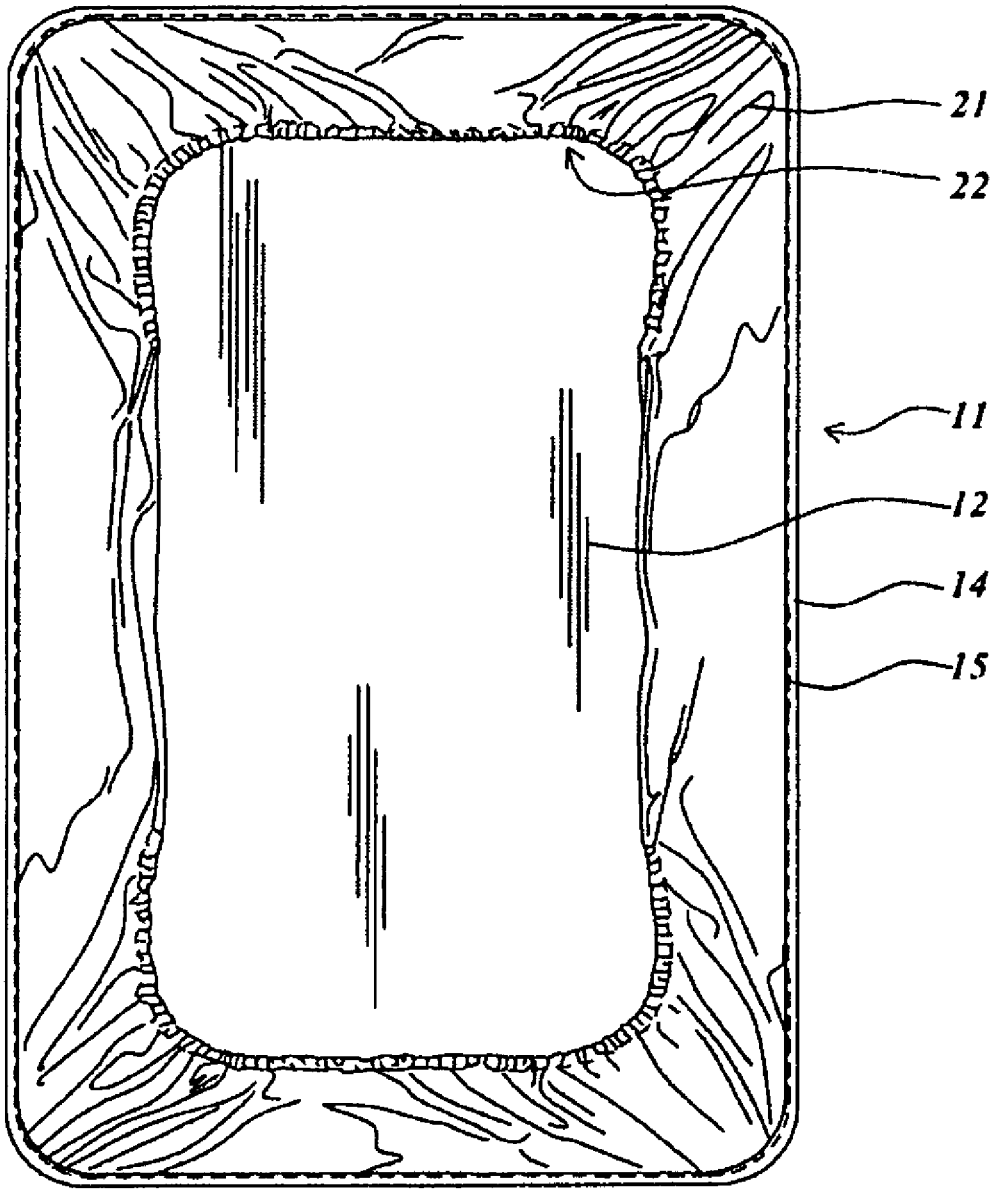
FIG. 1 is a plan view of an electric mat that includes a side cover according to an embodiment of the present invention.
Figure 2:
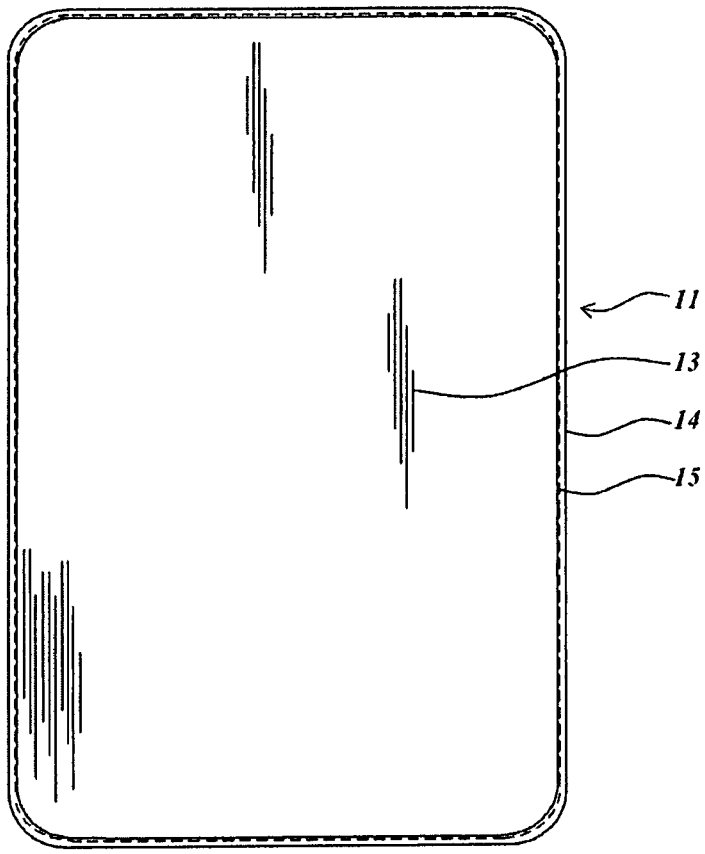
FIG. 2 is a bottom view of the electric mat of FIG. 1.
Figure 10:
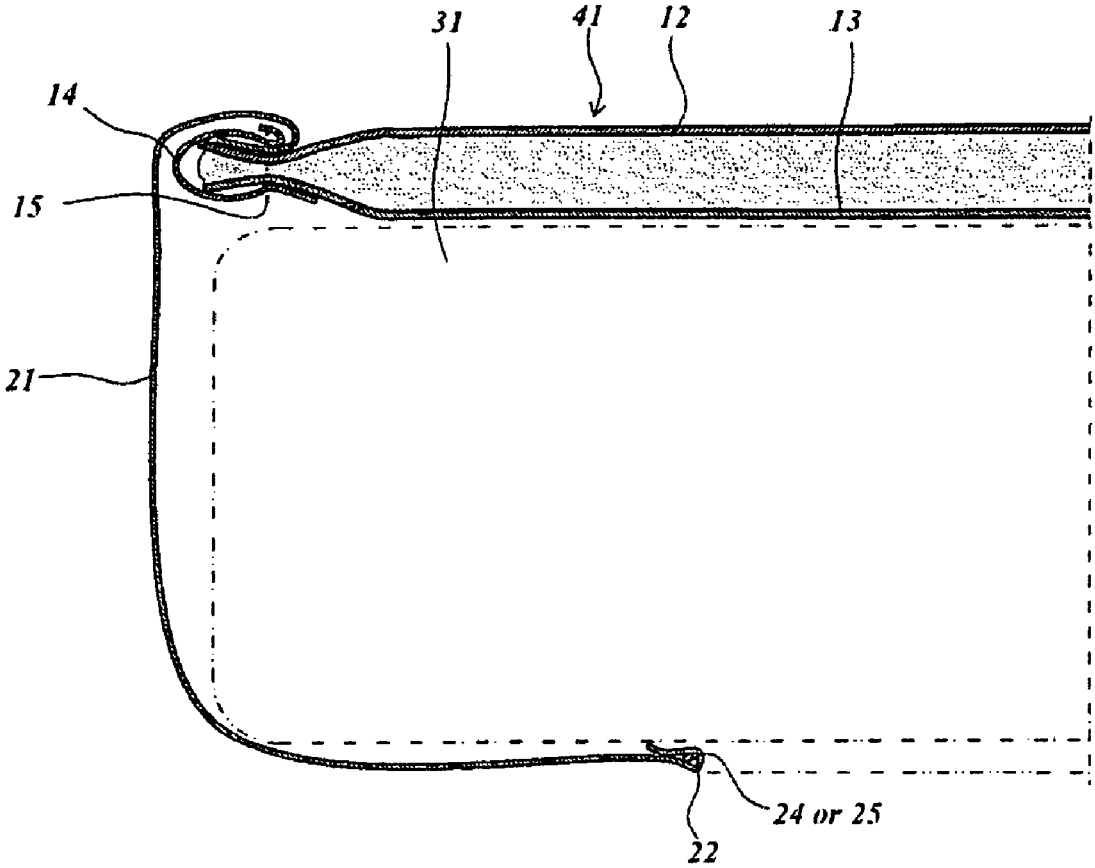
FIG. 10 is a partial enlarged sectional view of FIG. 9.

Referring to FIGS. 1 and 2, an electric mat 11 according to an embodiment of the present invention is a mat with an electric heater installed therein. Although not shown in the drawings, the electric heater is installed in the electric mat 11. By applying a commercial current to the electric heater of the electric mat, the electric heater is driven to emit heat of a predetermined temperature. Since the electric heater typically emits electromagnetic waves, the electric heater preferably has its electromagnetic waves bypassed to ground or are shielded. Sheets installed in the electric mat 11 together with the electric heater may include a sheet with an electric heater arranged therein or thereon, a sheet for bypassing electromagnetic waves, and a sheet for providing a certain degree of cushioning. The electric mat 11 may be made of materials commonly found in underquilts such that the electric mat 11 may be folded and put away. A surface layer 12 and a bottom surface layer 13 of the electric mat 11 may be made of a cloth produced by mix-spinning synthetic fiber yarn (e.g., polyester yarn) with cotton yarn. As seen in FIG. 10, the mat has a diminished thickness at its outer periphery.

In accordance with the present invention, a curtain-type side cover 21 attached to an outer periphery of the electric mat 11. The side cover 21 includes a contracting portion 22 disposed on an inner periphery of the side cover 21. Although the material of the side cover 21 is not particularly limited in any respect, the side cover 21 may be made of a cloth produced by mix-spinning synthetic fiber yarn, such as polyester yarn and cotton yarn. Such a cloth is inexpensive, easy to obtain, easy to work with during manufacture, easy to print or pattern print, not uncomfortable when contacting skin, and durable.

Referring to FIGS. 4 and 7-9, the curtain-type side cover 21 for an electric mat side cover apparatus of the present invention has a length L that covers a side surface of a mattress 31 of a bed 41 and lies on a bottom surface of the bed mattress 31.

Referring to FIGS. 1-3 and 7, the curtain-type side cover 21 for an electric mat side cover apparatus of the present invention is inserted under a bias 14 of the electric mat 11 at an upper surface of the electric mat 11 and attached to the bias 14 through a stitched seam 15 so as to simultaneously conceal the bias 14 of the electric mat 11 and the side surface of the bed mattress 31 during use. The bias may be a hem or a piece of material.

The side cover 21 of the present invention covers the top surface layer 12 of the electric mat 11 when the electric mat 11 is not assembled to the bed mattress 31. As shown in FIG. 1, the side cover 21 protects the top surface layer 12 of the electric mat 11.

Figure 7:
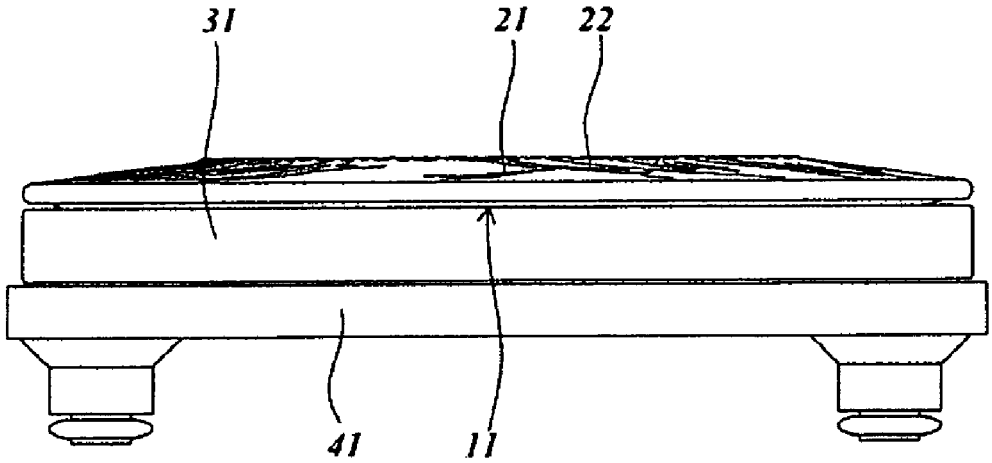
FIG. 7 is a schematic view illustrating the electric mat of the present invention in a state disposed on a bed mattress.
Figure 8:
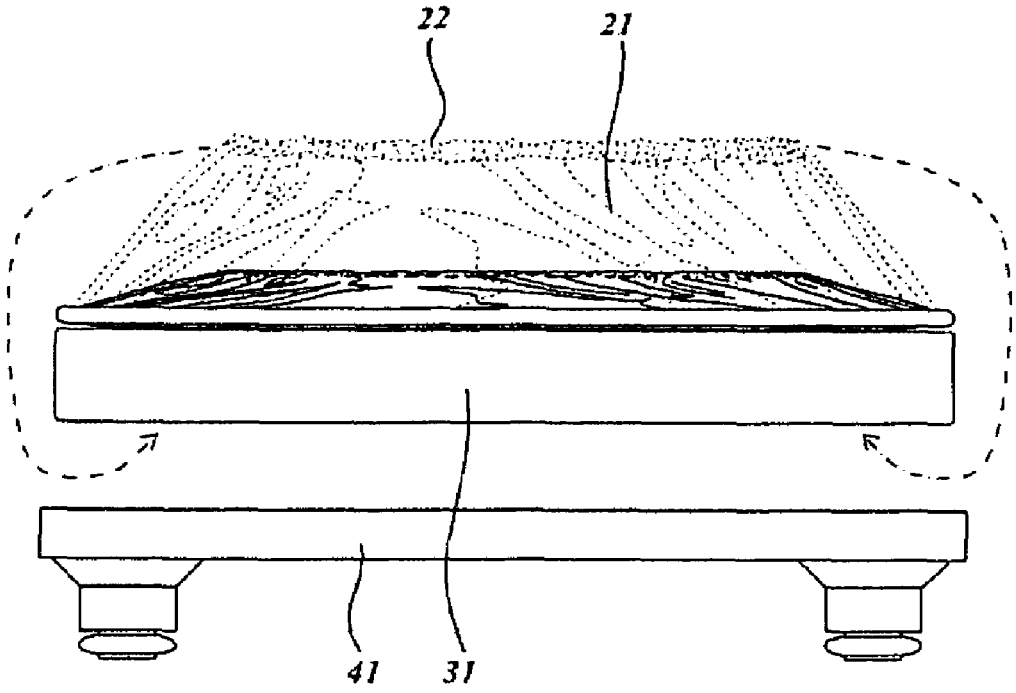
FIG. 8 is a schematic view used to describe assembly of the side cover according to an embodiment of the present invention on the bed mattress.
Figure 9:
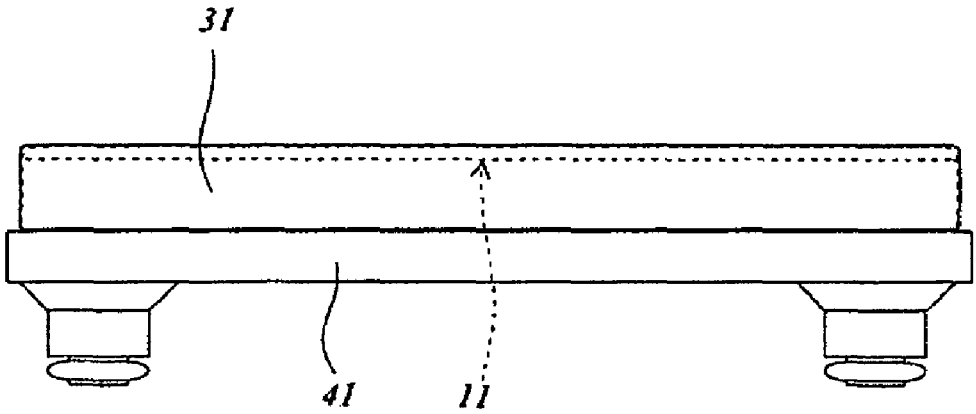
FIG. 9 is a front view of the bed mattress following completed assembly of the side cover thereon.

Processes for assembly of the electric mat 11 of the present invention to the bed mattress 31 are shown in FIGS. 7, 8, and 9. In FIG. 7, the electric mat 11 of the present invention is placed on the bed mattress 31. In FIG. 8, the contracting portion 22 is forced outward and moved to under the bed mattress 31. Consequently, as shown in FIG. 10, the side cover 21 conceals the side surface of the electric mat 11 and the side surface of the bed mattress 31.

The electric mat 11 is supported on the bed mattress 31 so as not to move horizontally, and peripheral portions of the side cover 21 and the contracting portion 22 are in close contact with the bottom surface of the bed mattress 31. Assembly of the electric mat 11 is complete in this state and the completed assembly of the electric mat 11 is shown in FIG. 9. In FIG. 9, the side cover 21 conceals the side surfaces of the electric mat 11 and the bed mattress 31 in such a manner that the combination appears as a single mattress placed on the bed 41. Although not shown in FIG. 9, when viewed from above, it is not apparent that the electric mat 11 is placed on the bed mattress 31 and the combination provides for a simplified outer appearance that looks as if a single mattress is placed on the bed 41.

Figure 3:
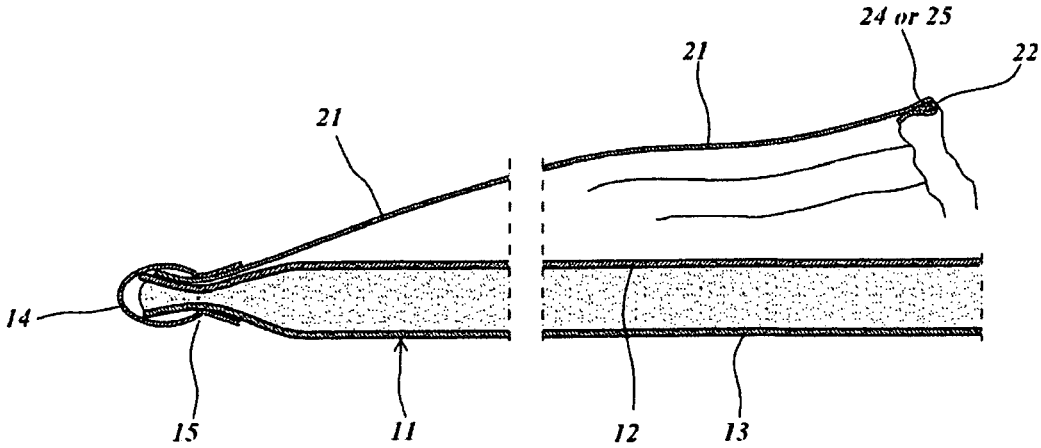
FIG. 3 is a partial enlarged sectional view of the electric mat of FIG. 1.
Figure 4:
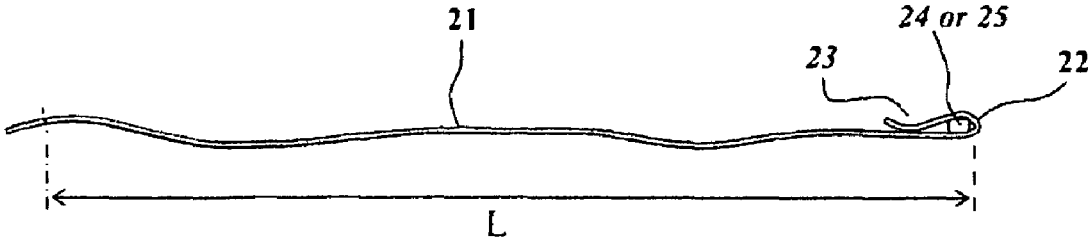
FIG. 4 is a detailed sectional view of the side cover according to an embodiment of the present invention.
Figure 5:
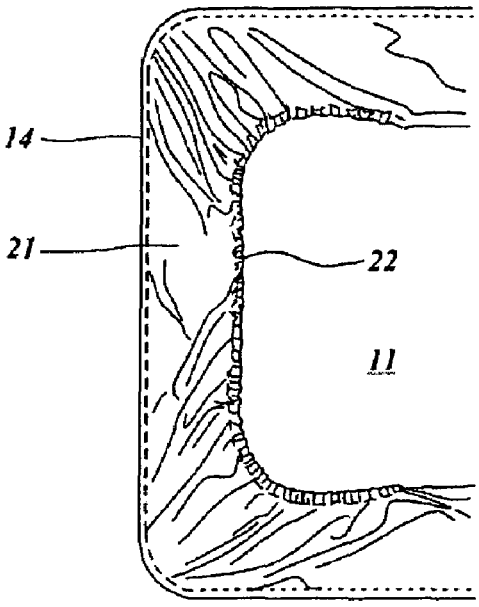
FIG. 5 is a plan view of a contracting portion disposed on the side cover according to an embodiment of the present invention.

The contracting portion 22 disposed on the inner periphery of the curtain-type side cover 21 for an electric mat side cover apparatus of the present invention is shown in FIGS. 3, 4, and 5. The contracting portion 22 disposed on the inner periphery of the curtain-type side cover 21 includes a contracting tube formed on the inner periphery of the curtain-type side cover 21 by a stitched seam 23, and an elastic band 24 inserted in the contracting tube. The contracting portion 22 shown in FIG. 5, which includes the elastic band 24, is placed in the state shown in FIG. 10 after undergoing the assembly processes shown in FIGS. 7 and 8 and through use of the elasticity of the elastic band 24 acting on the contracting portion 22 to contract the same.

Figure 6:
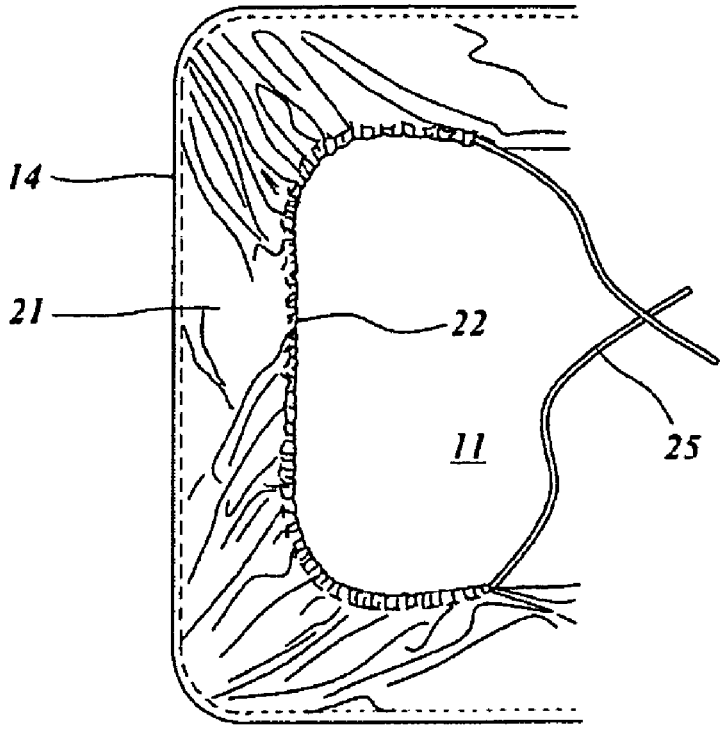
FIG. 6 is plan view of another exemplary embodiment of a contracting portion disposed on the side cover according to the present invention.

FIG. 6 shows an alternative exemplary embodiment of the side cover 21 in which a tightening band 25 is used in place of the elastic band 24 of the previous embodiment. In this embodiment, with reference to FIGS. 3, 4, and 6, the contracting portion 22 disposed on the inner periphery of the curtain-type side cover 21 includes the contracting tube formed on the inner periphery of the curtain-type side cover 21 by the stitched seam 23, and the tightening band 25 inserted in the contracting tube.

The tightening band 25 is a string that may be pulled by a user to tighten the same. In the case where the tightening band 25 is used in the contracting portion 22, in the state shown in FIG. 6, the ends of the tightening band 25 are grabbed and then tied together after drawing together the contracting portion 22. By pulling on and tying together the tightening band 25, the side cover 21 according to this embodiment in which the tightening band 25 is inserted into the contracting portion 22 is also able to conceal the side surfaces of the electric mat 11 and the bed mattress 31 in the manner shown in FIG. 10. Also, the electric mat 11 is supported on the bed mattress 31 such that the electric mat 11 does not experience any horizontal displacement, and the peripheral portions of the side cover 21 and the contracting portion 22 are in close contact with the bottom surface of the bed mattress 31. Hence, as shown in FIG. 9, the side cover 21 conceals the side surfaces of the electric mat 11 and the bed mattress 31 in such a manner that the combination appears as a single mattress placed on the bed 41. In FIG. 9, when viewed from above, it is not apparent that the electric mat 11 is placed on the bed mattress 31. Thus, the combination provides for a simplified outer appearance that looks as if a single mattress is placed on the bed 41.

For attachment to the electric mat 11, the curtain-type side cover 21 is inserted under the bias 14 of the electric mat 11 at the upper surface thereof and attached to the bias 14 through the stitched seam 15. Through this configuration, after assembly of the side cover 21 through the processes of FIGS. 7 and 8, the curtain-type side cover 21 simultaneously conceals the bias 14 of the electric mat 11 and the side surface of the bed mattress 31.

In accordance with one embodiment of the present invention, a side cover apparatus includes an electric mat, a curtain-type side cover attached to an outer periphery of the electric mat, and a contracting portion disposed on an inner periphery of the side cover.

Preferably, a length of the side cover covers a side surface of the bed mattress and closely contacts a bottom surface of the bed mattress.

Preferably, the side cover is inserted under a bias of the electric mat at an upper surface of the electric mat and attached to the bias through a stitched seam such that the side cover simultaneously conceals the bias of the electric mat and a side surface of the bed mattress during use.

Preferably, the contracting portion on the inner periphery of the side cover includes a contracting tube formed by stitching the inner periphery of the side cover. An elastic band inserted may also be into the contracting tube.

Alternatively, the contracting portion on the inner periphery of the side cover includes a contracting tube formed by stitching the inner periphery of the side cover and a tightening band is inserted into the contracting tube.

As described above, when the electric mat of the present invention is placed on the bed mattress, the electric mat does not move horizontally on the bed mattress and when the electric mat is placed on the bed mattress, the outer appearance is as if these two elements are a single bed mattress. Further, through the configuration by which the curtain-type side cover is connected to the outer periphery of the electric mat and the contracting portion is provided on the inner periphery of the curtain-type side cover, the curtain-type side cover conceals the side surface of the bed mattress. Additionally, the electric mat may be used in place of a bed sheet when placed on the bed mattress. Also, the electric mat is easily assembled to the bed mattress. Further, the side cover protects the upper surface of the electric mat during transport. Finally, after the electric mat is laid out on the bed mattress and the contracting portion is manipulated so as to be placed under the bed mattress, the side cover surrounds and closely contacts the side surface of the bed mattress.

While the present invention has been particularly shown and described with reference to exemplary embodiments thereof, it will be understood by those of ordinary skill in the art that various changed in form and details may be made therein without departing from the spirit and scope of the present invention as defined by the following claims.

What is claimed is:

1. A side cover apparatus comprising:

an electric mat including a hem attached to an outer periphery of the electric mat through a stitched seam, wherein the electric mat has a substantially diminished thickness between a top and a bottom surface layer of the outer periphery at the stitched seam;

a curtain-type side cover attached to the outer periphery of the electric mat; and a contracting portion disposed on an inner periphery of the curtain-type side cover, wherein the curtain-type side cover is inserted between the hem of the electric mat and the top surface layer of the electric mat and attached to the hem through the stitched seam so that the curtain-type side cover folds over the outer periphery of the electric mat and covers both the hem of the electric mat and a side surface of a bed mattress to provide a single mattress appearance when the side cover apparatus is placed on the bed mattress.

2. The side cover apparatus of claim 1, wherein the curtain-type side cover comprises a length that covers a side surface of a bed mattress and closely contacts a bottom surface of the bed mattress when the curtain-type side cover apparatus is placed on the bed mattress.

3. The side cover apparatus of claim 1. wherein the contracting portion comprises a contracting tube formed by stitching the inner periphery of the curtain-type side cover and inserting an elastic band into the contracting tube.

4. The side cover apparatus of claim 1, wherein the contracting portion comprises a contracting tube formed by stitching the inner periphery of the curtain-type side cover and inserting a tightening band into the contracting tube, wherein the tightening band comprises a first end and a second end.

5. The side cover apparatus of claim 4, wherein the first and the second end of the tightening band are exposed from the contracting tube.

6. The side cover apparatus of claim 5, wherein the tightening band is tightened by pulling and tying together the first and the second end of the tightening band.

7. The side cover apparatus of claim 1, wherein the electric mat comprises an electric heater.

* * * * *